US005718464A

United States Patent [19]

Mark

[11] Patent Number: 5,718,464

[45] Date of Patent: Feb. 17, 1998

[54] HUB CONNECTION ASSEMBLY

[75] Inventor: Darren M. Mark, Castaic, Calif.

[73] Assignee: Emhart Inc., Newark, Del.

[21] Appl. No.: 898,854

[22] Filed: Jul. 25, 1997

Related U.S. Application Data

[63] Continuation of Ser. No. 535,690, Sep. 28, 1995, abandoned.

[51] Int. Cl.[6] ..... F16L 19/02

[52] U.S. Cl. ..... 285/321; 285/8; 285/23; 285/354

[58] Field of Search ..... 285/8, 388, 275, 285/272, 321, 386, 354, 23

[56] References Cited

U.S. PATENT DOCUMENTS

| | | | |
|---|---|---|---|
| 738,503 | 9/1903 | Waters . | |
| 1,987,499 | 1/1935 | Tabozzi . | |
| 2,468,315 | 2/1949 | Wagner . | |
| 3,439,944 | 4/1969 | Leutenegger | 285/321 |
| 4,457,342 | 7/1984 | Moen . | |
| 4,484,600 | 11/1984 | Peterson et al. . | |
| 4,592,388 | 6/1986 | Wilcox . | |
| 4,739,523 | 4/1988 | Bondar . | |
| 5,050,911 | 9/1991 | Morrison | 285/321 X |
| 5,301,715 | 4/1994 | Becker . | |

FOREIGN PATENT DOCUMENTS

| | | | |
|---|---|---|---|
| 0117504 | 2/1984 | European Pat. Off. . | |
| 917193 | 1/1963 | United Kingdom | 285/321 |
| 942790 | 11/1963 | United Kingdom | 285/321 |

*Primary Examiner*—Terry Lee Melius
*Assistant Examiner*—Heather Shackelford
*Attorney, Agent, or Firm*—J. Bruce Hoofnagle

[57] ABSTRACT

A hub connection assembly 20 includes a hub 22 having a spout 28 extending therefrom. The assembly 20 further includes a trim nut 30 which is assembled with the hub 22 and also includes a split snap ring 32 which retains the hub with the trim nut. A lower section 26 of the hub 22 is formed with a outward facing annular recess 36 which receives a circular wall 74 of the ring 32. The ring 32 is also formed with an outward extending circular rib 68 which is located in an annular groove 48 formed in an inner circular wall of the trim nut 30. The wall 74 and the rib 68 of the ring 32 extend in a direction between the hub 22 and the trim nut 30 to maintain separation between the hub and the nut.

7 Claims, 4 Drawing Sheets

HUB CONNECTION ASSEMBLY

This is a Continuation of application Ser. No. 08/535/690, filed Sep. 28, 1995, now abandoned.

BACKGROUND OF THE INVENTION

This invention relates to a hub connection assembly, and particularly relates to the connection of a hub of a spout to a connection nut for assembly with a water supply facility.

In one style of a kitchen faucet, a long spout extends from a hub which is connected to a water supply system for supplying water selectively through the spout. In a system of this type, the spout is assembled with supporting structure in such a manner that the spout can be revolved or pivoted about a point at the rear of the spout to facilitate the positioning of the water dispensing end of the spout over selected portions of a sink beneath the spout. Typically, the spout and connecting elements are made of metal and there must be some intermediate element which prevents the metal portions of the spout from rubbing or contacting the metal support elements when the spout is revolved or pivoted.

In addition, the coupling facility used in the past to couple the rear of the spout to the water supply facilities has, at times, been a complex arrangement of elements which are difficult to assemble and require complicated manipulation of the elements to complete the assembly.

Therefore, there is a need for a simple, uncomplicated facility for coupling the rear of a spout to a water supply system which will insure secure connection of the spout to the supply system and will insure that there will be no metal-to-metal rubbing when the spout is revolved or pivoted.

SUMMARY OF THE INVENTION

It is, therefore, an object of this invention to provide a simple and inexpensive coupling for coupling a hub of a spout to a water supply assembly.

Another object of the invention is to provide a coupling facility for insuring a secure coupling of the hub of a spout to a water supply system while insuring that there will be no metal-to metal rubbing when the hub is rotated.

With these and other objects in mind, the present invention contemplates a hub connection assembly which includes a hub having coupling structure formed thereon. A coupling element to be assembled with the hub for movement relative thereto is formed with coupling structure. A coupler is formed with a first structure which is complementary to the coupling structure of the hub and is formed with a second structure which is complementary to the coupling structure of the coupling element. The first structure of the coupler is in assembly with coupling structure of the hub and the second structure of the coupler is in assembly with the coupling structure of the coupling element.

The present invention further contemplates that the coupler is formed with a third structure which is located to prevent the hub from engaging the coupling element.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
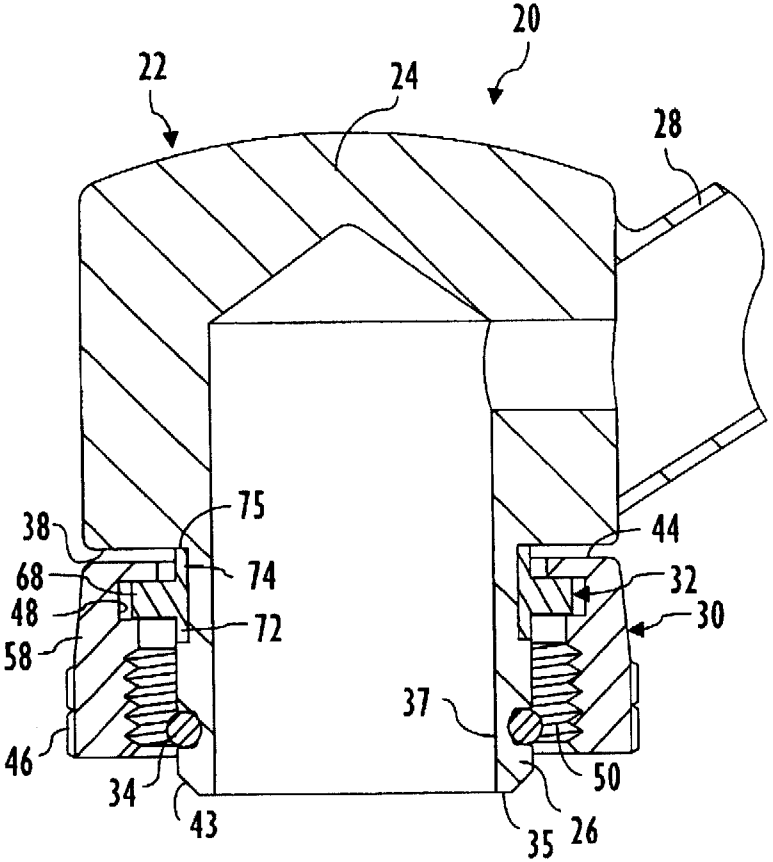
FIG. 1 is a sectional view showing a hub connection assembly in accordance with certain principles of the invention.

Referring to FIG. 1, a hub connection assembly 20 includes a hub 22 which is formed with a large upper section 24 having a first diameter and a stem-like lower section 26 having a second diameter smaller than the first diameter. A spout 28 (partially shown) is secured to the hub 22, for example, by brazing and extends upward and outward from the hub. A trim nut 30 is positioned about the lower section 26 of the hub 22. A snap ring 32 is assembled with the lower section 26 of the hub 22 and also with the trim nut 30. An O-ring 34 is assembled on the hub connection assembly 20 near a lower end 35 of the lower section 26 of the hub 22.

Figure 2:
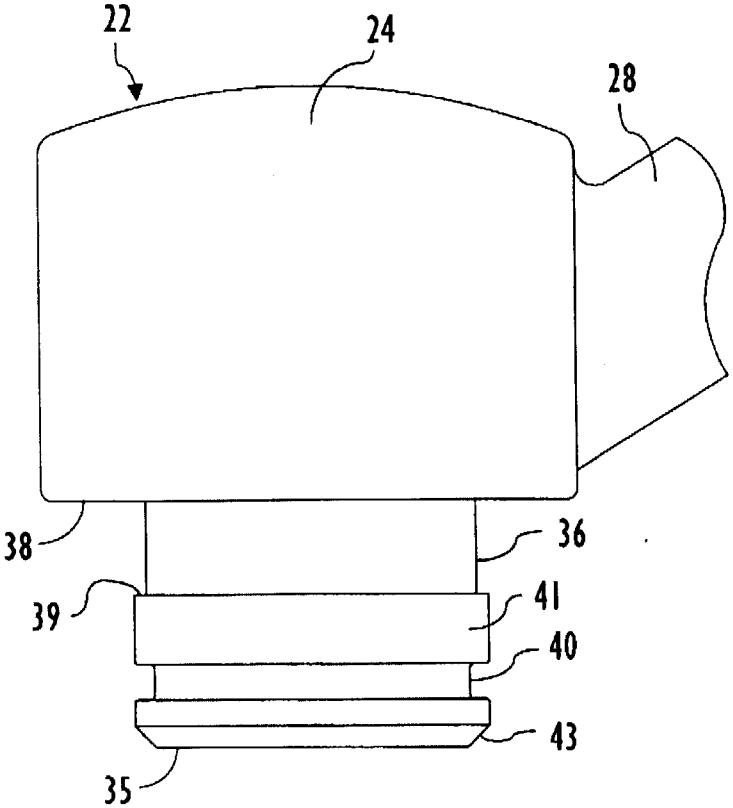
FIG. 2 is a side view showing a hub of the hub connection assembly of FIG. 1 formed with structure in accordance with certain principles of the invention.

As shown in FIG. 2, the lower section 26 of the hub 22 is formed with an annular recess 36 adjacent an underside 38 of the upper section 24 thereof. The hub 22 is formed with a water passage 37 from the lower end 35 to a juncture with the spout 28. An annular groove 40 is formed in the lower section 26 of the hub 22 intermediate the recess 36 and the lower end 35 thereof. The annular recess 36 extends from the underside 38 of the upper section 24 of the hub 22 by a prescribed axial distance to a ledge 39 formed by an intermediate section 41 of the lower section 26 of the hub. In addition, the depth of the recess 36 extends radially inboard of the-outer surface of the intermediate section 41 by a prescribed distance. The lowest portion of the lower section 26 is formed with a bevel 43 which extends around the section.

Figure 4:
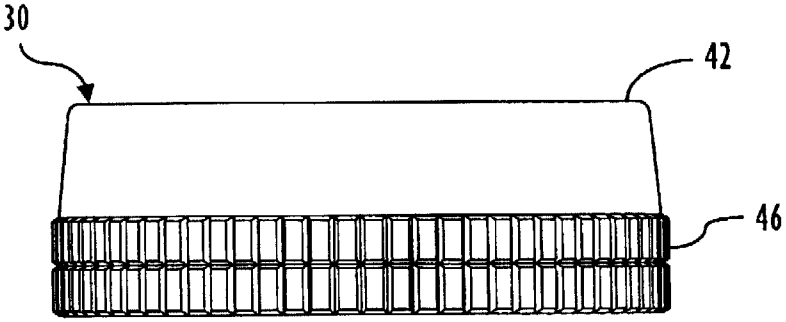
FIG. 4 is a side view showing the trim nut of FIG. 3.
Figure 5:
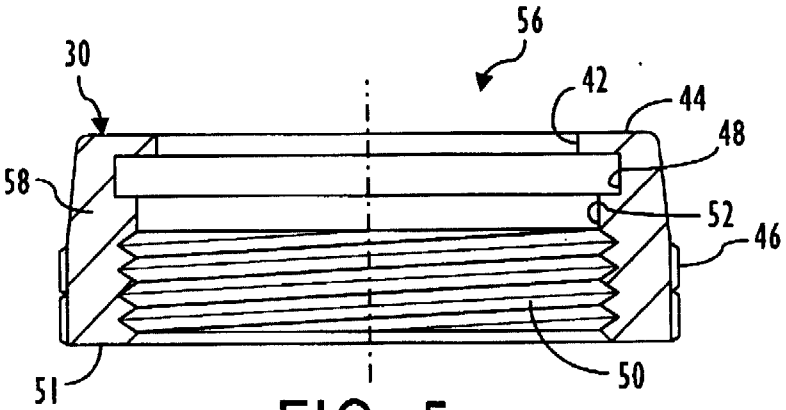
FIG. 5 is a sectional view taken along line 5—5 of FIG. 3 showing structure in accordance with certain principles of the invention.
Figure 3:
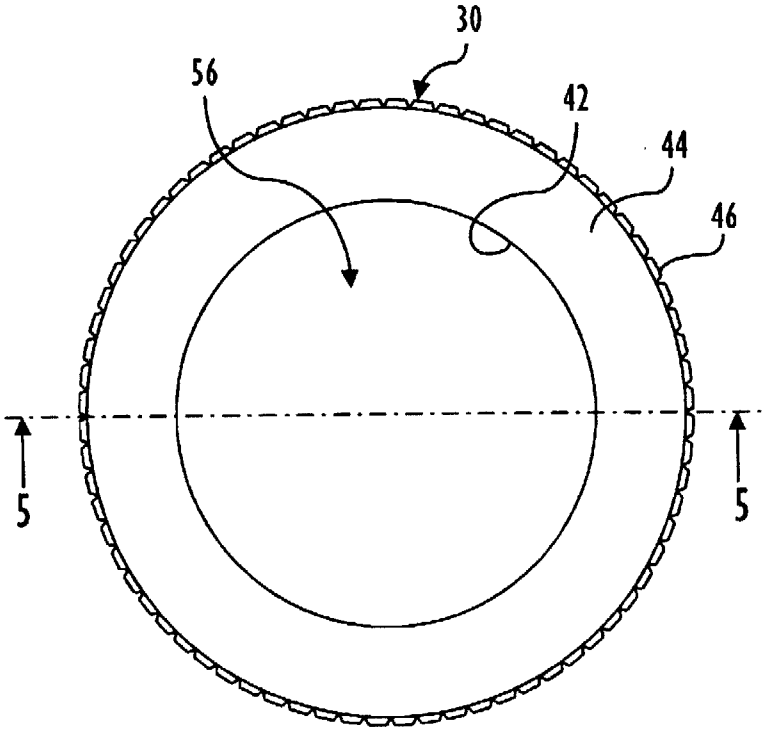
FIG. 3 is a top view of a trim nut of the hub connection assembly of FIG. 1.

Referring to FIG. 3, trim nut 30 is formed in a circular configuration with a central opening 42 in a top surface 44 thereof. As shown in FIG. 4, trim nut 30 is formed with a knurled structure 46 on at least a portion of the outer surface of the nut. As shown in FIG. 5, the trim nut 30 is formed internally with an annular groove 48 adjacent and axially inboard of the opening 42. Internally, the trim nut 30 is formed with a section of threads 50 which extend axially upward from a bottom 51 of the nut. An annular unthreaded portion 52 is formed between the section of threads 50 and the annular groove 48. The opening 42, groove 48, unthreaded portion 52 and the threads 50 combine to form an axial passage 56 formed axially through the trim nut 30.

The annular groove 48 is formed with a prescribed diameter such that the groove extends into a wall 58 of the nut 30 by a prescribed distance from the axis of the nut. In addition, the axial height of the groove 48 is formed with a prescribed dimension so that the groove has a defined axial height.

Figure 7:
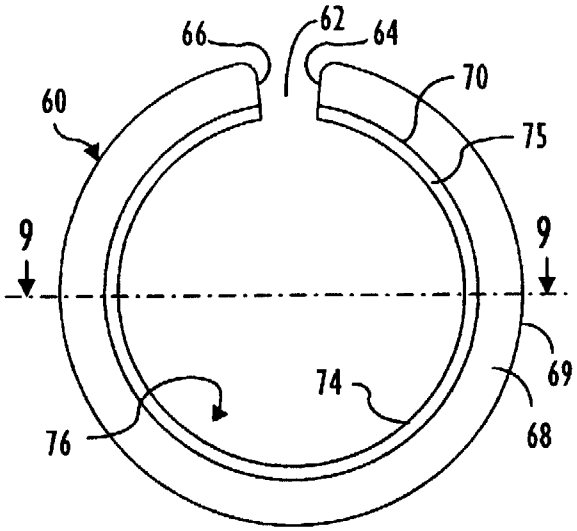
FIG. 7 is a top view showing the snap ring of FIG. 6.
Figure 9:
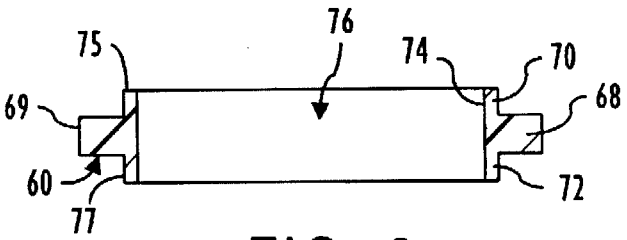
FIG. 9 is a sectional view taken along line 9—9 of FIG. 7 showing the snap ring of FIG. 6.
Figure 6:
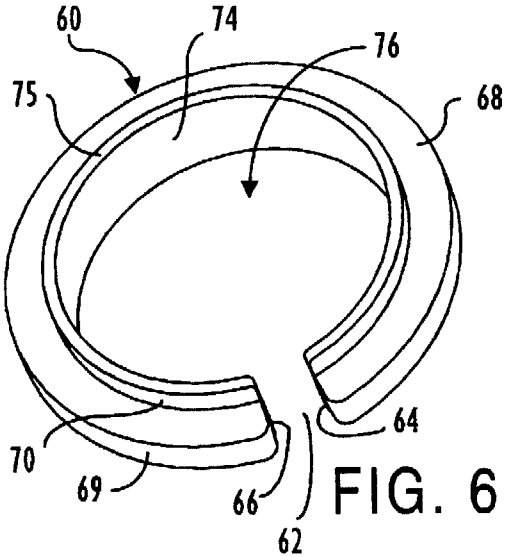
FIG. 6 is a perspective view showing the snap ring of FIG. 1 in accordance with certain principles of the invention.
Figure 8:
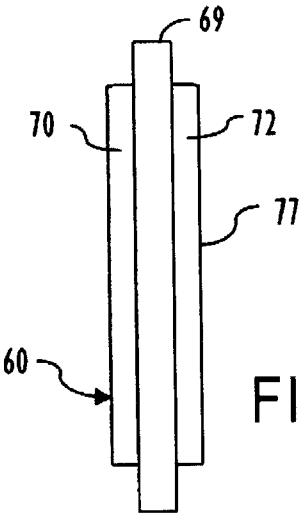
FIG. 8 is a side view showing the snap ring of FIG. 6.

Referring to FIG. 6, the snap ring 32 is composed of a plastic material such as, for example, nylon of the type available from DuPont under the trademark "Zytel." The snap ring 32 is formed with an opening 62 and is, therefore, a split ring. The opening 62 forms a space between opposed ends 64 and 66 of the ring 32 and possesses a resiliency which allows the ends to be urged together. However, when there is no force to urge the ends 64 and 66 of the ring 32 toward each other, the ring is in an open position and the ends assume a natural spacing as illustrated in FIGS. 6 and 7 resulting in the opening 62.

The ring 32 is formed with a central annular rib 68 which extends radially outward a prescribed distance and which is formed with an outer surface 69. The rib 68 has an axial height which is essentially the same as the defined axial height of the annular groove 48 of the trim nut 30. A pair of annular walls 70 and 72 extend in opposite axial directions from the inside of the annular rib 68 as shown in FIGS. 6, 7, 8 and 9. The inner surfaces of the rib 68 and the walls 70 and 72 form an annular inner wall 74 of the snap ring 32 which are contiguous with a top edge 75 and a bottom edge 77 of the ring. The inner wall 74 defines an axial opening 76 of the ring. The axial height of the inner wall 74 between the top edge 75 and the bottom edge 77 is essentially the same as the prescribed axial height of the annular recess 36 of the hub 22.

Figure 10:
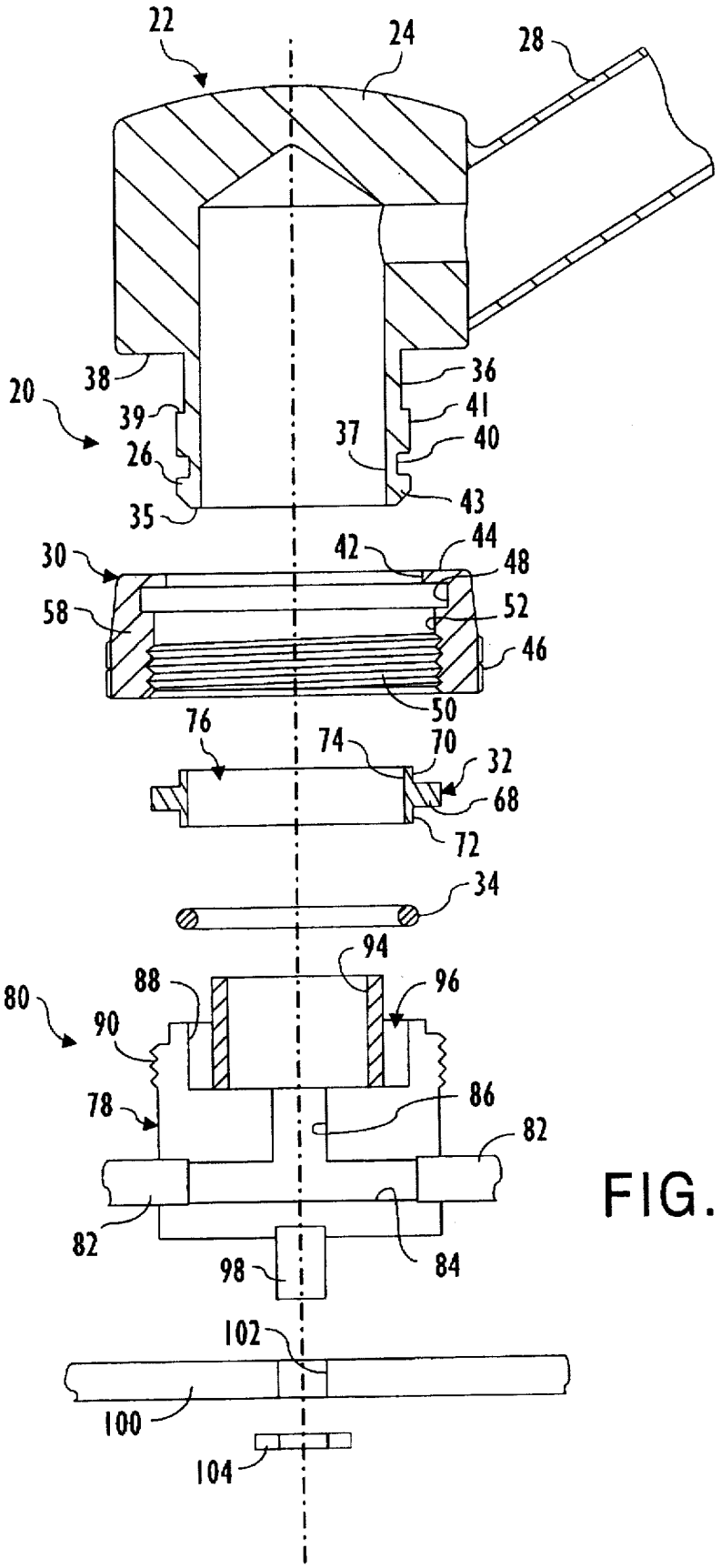
FIG. 10 is exploded view of the hub connection assembly of an FIG. 1 in position for assembly with portions of a water supply system.

As shown in FIG. 10, the individual elements of the hub connection assembly 20 are arranged in an exploded alignment and are positioned above a center body 78 of a water mixing assembly 80 (partially shown). The water mixing assembly 80 further includes two end bodies (not shown) which are connected to the center body 78 through two conduits 82 which, in turn, communicate with water passages 84 and 86 within the center body. The upper portion of the center body 78 is formed with an internal cylindrical-like well 88 and with external threads 90. A cylinder 92 is located coaxially within the well 88 and is formed with a water passage 94 which communicates with water passage 86. The outer wall of the cylinder 92 and the inner wall of the well 88 define a circular space 96. A threaded nipple 98 is attached axially to the bottom of the center body 88 and a putty plate 100 with a hole 102 is located for positioning on the nipple to be secured there by placement of a nut 104 on the nipple.

Referring further to FIG. 10, when assembling the elements of the hub connection assembly 20, the snap ring 32 is compressed manually radially inward so that the ends 64 and 66 are moved into engagement. The manually compressed ring 32 is then inserted into the threaded end of the axial passage 56 of the trim nut 30 and the manual compression is removed. The ring 32 tends to return to the open position as illustrated in FIG. 7. However, the outer surface 69 of the rib 68 engages the threads 50 of the trim nut 30 and the ring is prevented from returning fully to the open position of FIG. 7. The snap ring 32 is moved further into the passage 56 until the rib 68 of the ring is aligned with the annular groove 48 of the trim nut 30. At this position, the rib 68 of the partially compressed ring 32 is allowed to move radially into the annular groove 48 of the trim nut 30 as shown in FIG. 1 because the axial heights of the rib and the groove are essentially the same as noted above. In this manner, the snap ring 32 is in its open position and is retained with the trim nut 30. It is noted that the rib 68 of the snap ring 32 has not moved fully radially into the annular groove 48 of the trim nut 30 even though the ring has assumed its open position.

The lower section 26 of the hub 22 is then moved through opening 42 of the trim nut 30 and into the passage 56 thereof. Eventually, the bevel 43 at the bottom of the lower section 26 of the hub 22 is moved into the axial opening 76 of the snap ring 32. The bevel 43 of the hub 22 engages the contiguous edge between the top edge 75 and the inner wall 74 of the ring 32 essentially to expand or stress the ring gradually and radially outward from its open position and thereby allow the lower section 26 of the hub 22 to move into the axial opening 76 of the ring. Due to the above-noted additional radially outward space within the annular groove 48 of the trim nut 30 which was not previously occupied by the rib 68 of the snap ring 32, the ring is allowed to be stressed outward as noted above whereby the rib moves further radially outward into the annular groove. Since the axial height of the inner wall 74 of the snap ring 32 is greater than the axial height of the annular groove 40 of the hub 22, the groove 40 is allowed to move through the axial opening 76.

Eventually, the top edge 75 of the snap ring 32 engages the underside 38 of the hub 22 to prevent further movement of the lower section 26 of the hub through the axial opening 76 of the ring. At this position, the annular recess 36 of the hub 22 and the inner wall 74 are radially aligned. Since the axial heights of the recess 36 and the inner wall 74 are essentially the same as noted above, and since the ring has been stressed radially outward by the hub 22, the snap ring 32 tends to return to its open position as shown in FIG. 7 whereby the inner wall 74 and the adjacent portions of the ring move into the annular recess 36 of the hub 22 as shown in FIG. 1. In this position, the ring 30 is still stressed slightly radially outward whereby the inner wall 74 thereof fits snugly against the adjacent wall of the annular recess 36 of the hub and is retained therewith. In this manner, the hub 22, trim nut 30 and snap ring 32 are retained together to form the hub connection assembly 20.

It is noted that the upper portion of wall 70 of ring 32 extends above the top surface 44 of the trim nut 30 whereby the underside 38 of the hub 22 is precluded from engaging the top surface of the nut. This assembly prevents metal-to-metal contact between the metal hub 22 and the metal trim nut 30 but does allow the metal hub to engage the top edge 75 of the plastic snap ring 32. The plastic surface of the top edge 75 of the snap ring 32 provides a smooth and long-wearing bearing surface for the underside 38 of the hub 22. With this structure, the spout 28 can be freely and smoothly rotated when being positioned over a sink (not shown) in normal use thereof.

The O-ring 34 is then slipped over the bevel 43 and lower portion of the lower section 26 of the hub 22 and is positioned within the annular groove 40 as shown in FIG. 1.

It is noted that during the period after the elements of the hub connection assembly 20 have been assembled, and before the assembly 20 is connected to the center body 78, the hub 22 can shift laterally with respect to the trim nut 30 which could result in metal-to-metal contact between the hub and the trim nut. However, the rib 68 of the plastic snap ring 32 is located within the annular groove 48 of the trim nut 30 and precludes any lateral movement of the hub 22 sufficient to cause metal-to-metal contact between the hub and the trim nut. Thus, the locating of the top edge 75 of the snap ring 32 a prescribed distance above the top surface 44 of the trim nut 30, and the positioning of the rib 68 of the snap ring within the annular groove 48 of the trim nut, precludes the possibility of any metal-to-metal contact between the hub 22 and the snap ring. This is so even though the rib 68 can be moved laterally of the axis of the snap ring 30 by a limited distance within the annular groove 48.

The hub connection assembly 20 can be positioned over the center body 78 as shown in FIG. 1 and moved into assembly therewith by positioning the passage 37 of the hub over the cylinder 92 of the center body. In this assembly, the lower section 26 of the hub 22 is moved into the space 96 of the center body 78 and the threads 50 of the trim nut 30 threadedly engage the threads 90 of the center body to secure the hub connection assembly 20 with the center body.

In general, the above-identified embodiments are not to be construed as limiting the breadth of the present invention. Modifications, and other alternative constructions, will be apparent which are within the spirit and scope of the invention as defined in the appended claims.

What is claimed is:

1. A connection assembly for connecting a trim nut to a hub of a spout and for maintaining a spaced relation between the hub and an assembly of the trim nut and a fluid flow housing during a period of relative rotation between the hub and the assembly, which comprises:

a cylindrical-like passage formed through, and along an axis of, the trim nut to provide an axial opening formed internally of a wall of the trim nut and which extends axially from a first axial end of the passage to a second axial end of the passage;

an annular groove formed internally in the wall of the trim nut at a prescribed axial distance from the first axial end of the passage thereof and having a base wall parallel with the axis and which is located a prescribed radial distance from the axis thereof and having an axial length which extends in an axial direction for a prescribed distance;

the hub formed with a first cylindrical-like section about an axis thereof at a first diameter;

the hub formed with a second cylindrical-like section spaced from the first section and about the axis of the hub at a second diameter which is less than the first diameter;

the hub formed with an annular recess in the form of a third cylindrical-like section about the axis of the hub and integrally with and between the first section and second section thereof with a base wall which is parallel with the axis of the hub and located a prescribed radial distance from the axis and at a prescribed third diameter which is less than the second diameter;

the third section of the hub formed with an axial height which is defined by a space between the first and second sections of the hub;

at least portions of the third section of the hub located within the cylindrical-like passage of the trim nut with at least a portion of the third section of the hub being located adjacent and spaced from the annular groove of the trim nut;

a generally circular ring formed along an axis thereof and having a opening extending radially therethrough to form a split in the ring with the opening having opposed first and second ends;

the ring being resilient such that the ring assumes a normal at rest state where the opposed first and second ends thereof are spaced apart by a prescribed distance and the ring is formed with an outside diameter and an inside diameter where, when the ring is in the normal state, the inside diameter is less than the third diameter of the third section of the hub;

the ring being formed with a generally cylindrical section having an inner wall about the axis of the ring and the cylindrical section has an axial height substantially the same as the axial height of the third section of the hub;

the ring being formed with a annular rib extending radially outward for a prescribed distance from the cylindrical section of the ring and formed with a peripheral surface;

the ring being in a radially expanded state relative to the normal state with the inner wall of the cylindrical section thereof located in biasing engagement with the base wall of the third section of the hub;

the annular rib extending partially into the annular groove of the trim nut with the peripheral surface thereof being spaced radially inward from the base wall of the annular groove; and a portion of the cylindrical section of the ring extends outward from the first end of the passage of the trim nut in an axial direction for a prescribed axial distance and a portion of the hub and a portion of the trim nut which face each other are spaced from each other by the proscribed axial distance.

2. The connection assembly as set forth in claim 1, wherein the first cylindrical section of the hub is formed with an underside, a portion of which forms a radial wall of the third section of the hub.

3. The connection assembly as set forth in claim 1, wherein the annular rib of the ring extends radially outward from an intermediate portion of the cylindrical section of the ring.

4. The connection assembly as set forth in claim 2, wherein the trim nut is formed with an outer surface which is transverse to the axis thereof and which, together with the underside of the hub, form the portions of the hub and trim nut which face each other.

5. The connection assembly as set forth in claim 1, wherein the passage of the trim nut includes a threaded portion from the second end thereof which is axially opposite the first end and inward toward the annular groove.

6. The connection assembly as set forth in claim 5, wherein the passage of the trim nut is formed by a first section, a second section and a third section, with the first section including the threaded portion as a segment thereof, the second section being the annular groove and the third section extending from the second section to the first end thereof.

7. The connection assembly as set forth in claim 6, wherein the first section of the trim nut is formed at a prescribed diameter, the second section is formed at a diameter greater than the prescribed diameter and the third section is formed at a diameter less than the prescribed diameter.

* * * * *